United States Patent [19]

Frazer

[11] 4,016,995

[45] Apr. 12, 1977

[54] LIQUID CONTAINER

[75] Inventor: John S. Frazer, Pequannock, N.J.

[73] Assignee: Plastipak Packaging, Detroit, Mich.

[22] Filed: Dec. 8, 1975

[21] Appl. No.: 638,622

[52] U.S. Cl. ..... 215/10; 206/431; 215/100 A; 215/1 C

[51] Int. Cl.[2] ..... B69D 21/00

[58] Field of Search ..... 215/10, 1 R, 1 C, 100 A; 206/431

[56] References Cited

UNITED STATES PATENTS

| | | | |
|---|---|---|---|
| 59,333 | 10/1866 | Bullard | 215/1 |
| 1,073,997 | 9/1913 | London | 215/1 |
| 2,071,847 | 2/1937 | Leppke | 215/10 |
| 3,369,688 | 2/1968 | Dike | 215/10 |

FOREIGN PATENTS OR APPLICATIONS

| | | | |
|---|---|---|---|
| 22,114 | 4/1912 | United Kingdom | 215/1 |
| 1,074,558 | 7/1967 | United Kingdom | 215/10 |

*Primary Examiner*—Ro E. Hart
*Attorney, Agent, or Firm*—Hume, Clement, Brinks, Willian & Olds

[57] ABSTRACT

The disclosure relates to a liquid container, the lower lateral portion of which has five principal sides arranged to permit five such containers to be carried in a square sided carrying case.

27 Claims, 6 Drawing Figures

LIQUID CONTAINER

BACKGROUND OF THE INVENTION

This invention relates to containers, and particularly to containers for liquids and beverages such as milk.

Liquids and beverages, and in particular milk, have generally been bottled in standard size containers such as one-quart, half-gallon and one-gallon size. Standard size packing cases have been developed to efficiently hold and transport a number of these individual containers from the packaging or bottling plant to the retail outlets. In particular, a standard size packing case has been developed to hold and transport four individual one-gallon containers and is in extensive use throughout the dairy industry. Recently, the concept of packaging liquids such as milk in intermediate size, three-quart containers has developed. Typically, a scaled down version of the standard one-gallon container has been used as the three quart container. The result of this practice has been that a standard four gallon packing case can still hold and transport only four of these scaled down containers and thus, only 12 quarts of milk can be carried in the case instead of the 16 quarts it was designed to carry when filled with one-gallon containers. This is quite inefficient since a delivery truck can carry only a fixed number of cases and thus can deliver only three quarts of the previous amount of milk per load. Accordingly, there has developed a need for an improved container or bottle which can better utilize the space available in the presently used four gallon size packing case and would not cause the industry to cast aside its stock of standard size carrying cases and develop a new case just for the scaled down three-quart containers.

SUMMARY OF THE INVENTION

The lateral enclosure of the liquid container of this invention has a series of principal side panels and at least the lower portion of the container has five such principal panels. These principal panels include two relatively wide front panels which intersect and are generally perpendicular to each other. To each of these front panels is connected a somewhat narrower intermediate panel which is generally perpendicular to the front panel to which it is connected. The last principal panel forming at least the lower portion of the lateral enclosure of the container, the rear panel, is relatively wide and is connected to both of the intermediate panels. Generally, the upper portion of the container has only four principal side panels and among these are the rear panel and the two intermediate panels. The liquid container of this invention also has a bottom enclosure forming a stable base which is connected to the lower edges of the rear panel, the intermediate panels and the two front panels and a top which generally has a neck extending from it to provide for easy pouring and capping. Preferably, the container of this invention has a liquid capacity of approximately three quarts.

Advantageously, the lower portion of the lateral enclosure of liquid container of this invention has a single long, wide rear panel and two long, relatively narrow intermediate panels adjacent the rear panel with each intermediate panel being located at an angle of approximately 135° with respect to the rear panel. Two relatively short, wide front panels are connected to the lower portions of the intermediate panels. These front panels intersect and are generally perpendicular to each other, and each front panel is also generally parallel to the intermediate panel opposite it. The upper portion of the lateral enclosure is of smaller cross-section and has only four principal panels, the rear and two intermediate panels mentioned above and a generally sloped upper front panel which is connected to the side panels and on the upper edges of the main front panels.

Also, the liquid container of this invention advantageously has a flow-thru handle, integral with the upper portion of the lateral enclosure, which is designed for easy hand gripping, and recesses in the front panels for insertion of a disk identifying the bottler or producer of the product.

This invention also relates to a generally square packing case containing five of the liquid containers of this invention.

Among the many features and advantages of this invention is the better space utilization provided in storing, transporting and displaying the product within the container. For example, in the preferred three-quart size which is now coming into use in the dairy industry, five three-quart milk containers of this invention may be placed in a standard packing case designed for four individual one-gallon milk containers. This substantially reduces storing and transportation costs for selling milk in three-quart sized containers as 15 quarts of milk may now be placed in a standard packing case versus only 12 quarts when the typical scaled down version of a gallon sized milk container is used. This means that the dairy industry can come close enough to its former volume per case capacity to avoid having to cast aside its old packing cases and spend large sums of capital for new packing cases especially designed for the three-quart milk containers.

Additional features and advantages of this invention are described in, and will appear from, the description of the preferred embodiments which follow and from the drawings to which reference is now made.

BRIEF DESCRIPTION OF THE DRAWINGS

FIG. 6 is a top plan view of a standard beverage carrying case designed for transporting four individual gallon size containers containing five containers of this invention.

DESCRIPTION OF THE PREFERRED EMBODIMENTS

Figure 1:
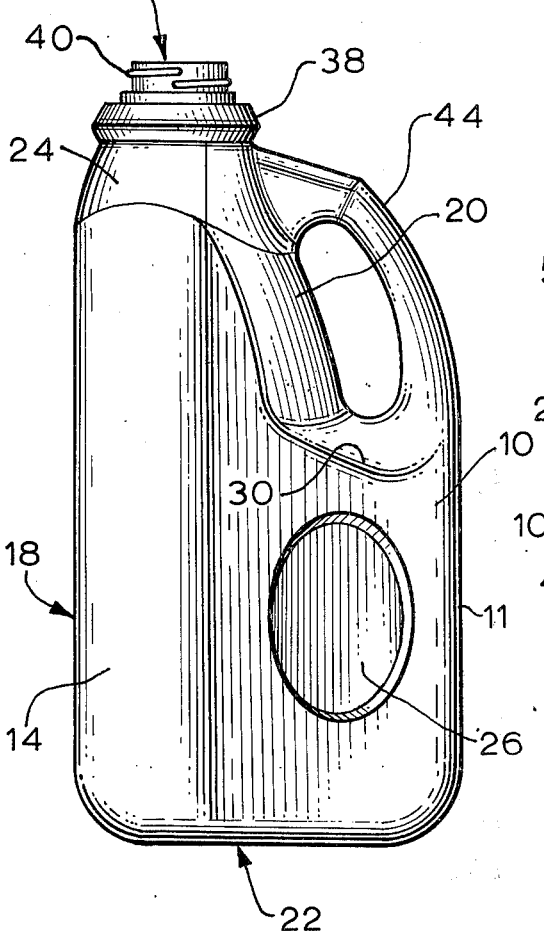
FIG. 1 is a side elevation view of a preferred embodiment of the liquid container of this invention.
Figure 3:
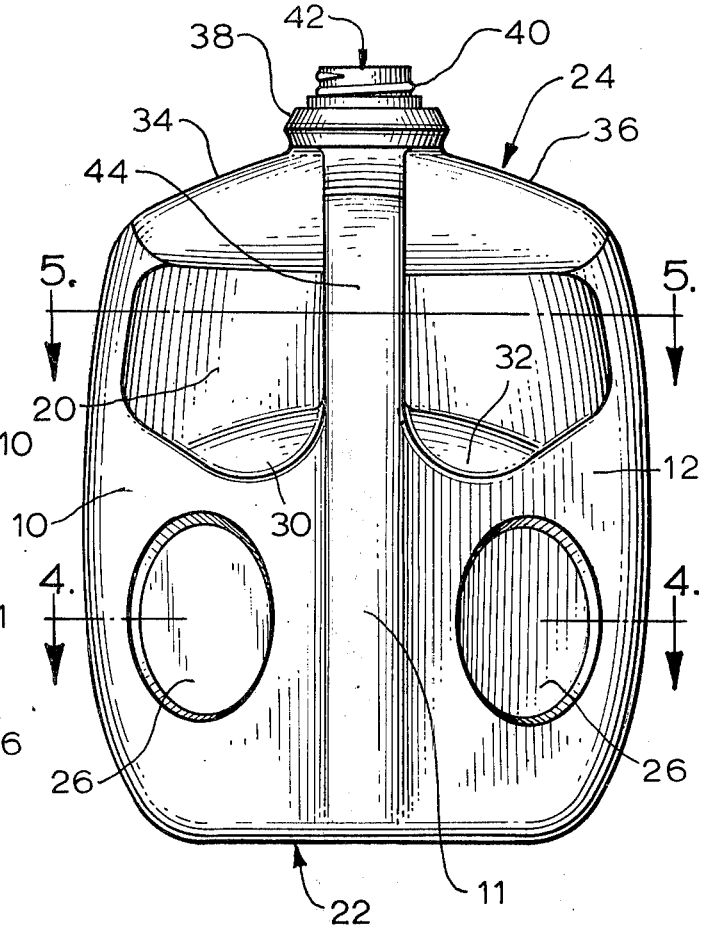
FIG. 3 is a front elevation view of the liquid container of FIG. 1.
Figure 2:
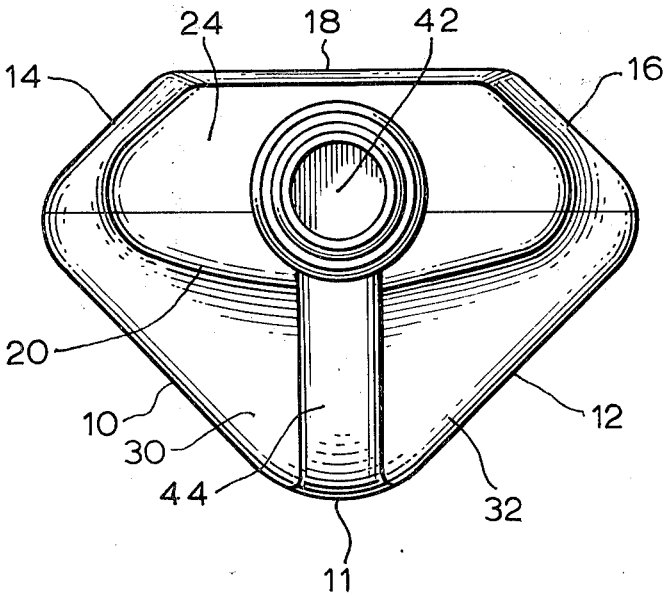
FIG. 2 is a top plan view of the liquid container of FIG. 1.

A preferred embodiment of the container of this invention is illustrated in FIGS. 1–5 of the drawings. The container has a lateral enclosure which is formed by a series of principal panels, two main front panels, indicated by reference numerals 10, 12, two intermediate side panels 14, 16, a single rear panel 18 and an upper front panel 20 and also has a bottom 22 and an upper or top surface 24.

Figure 4:
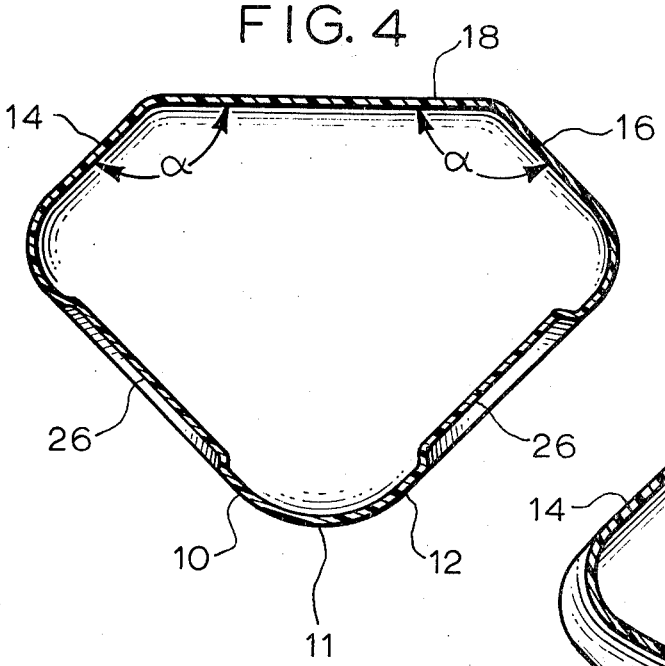
FIG. 4 is a cross sectional view of the liquid container of FIGS. 1–3 taken along line 4—4 shown in FIG. 3.

The lateral enclosure which forms the lower portion of the container has five principal panels (see FIG. 4). The two wide front panels 10, 12 intersect at a rounded corner 11 and are essentially perpendicular to each other. These front panels extend from the bottom 22 approximately half way to the top 24. They may optionally include recesses 26 for the insertion of the bottler's label or product identification. The two intermediate side panels 14, 16 are relatively narrower than the front panels but extend almost the full height of the container. The lower portion of each of these intermediate panels 14, 16 is connected to one of the front panels 10, 12 at a rounded corner. Each intermediate panel 14, 16 is essentially perpendicular to the front panel to which it is connected.

These four panels, the two front panels 10, 12 and the two intermediate panels 14, 16, form the sides of a square, but one which is interrupted due to the presence of the fifth principal panel, rear panel 18, which is connected to the two intermediate panels 14, 16. Rear panel 18 has a relatively wide surface and, like the intermediate panels, extends almost the full height of the container. Rear panel 18 appears generally flat when the container is empty, but when full preferably has a slightly convex bulge.

Rear panel 18 is connected to each of the two intermediate panels at an internal angle ($\alpha$ in FIG. 4) of approximately 135° so that when four identical containers, 50, 52, 54, 56 are arranged in a square carrying case 70, the rear sides of the four containers define a generally square opening between them 60 large enough to receive a fifth identically shaped container 58 (see FIG. 6).

The bottom enclosure 22 of the liquid container of this invention is formed by connecting together the lower edges of the two front panels 10, 12, the two intermediate panels 14, 16 and rear panel 18.

Figure 5:
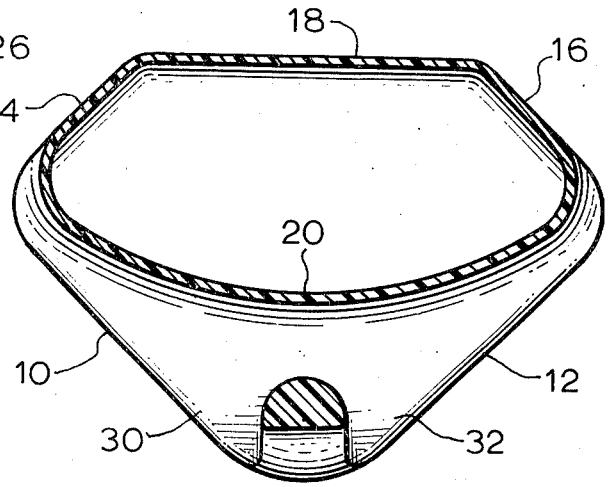
FIG. 5 is a cross sectional view of the liquid container of FIGS. 1–3 taken along line 5—5 shown in FIG. 3.
Figure 5:
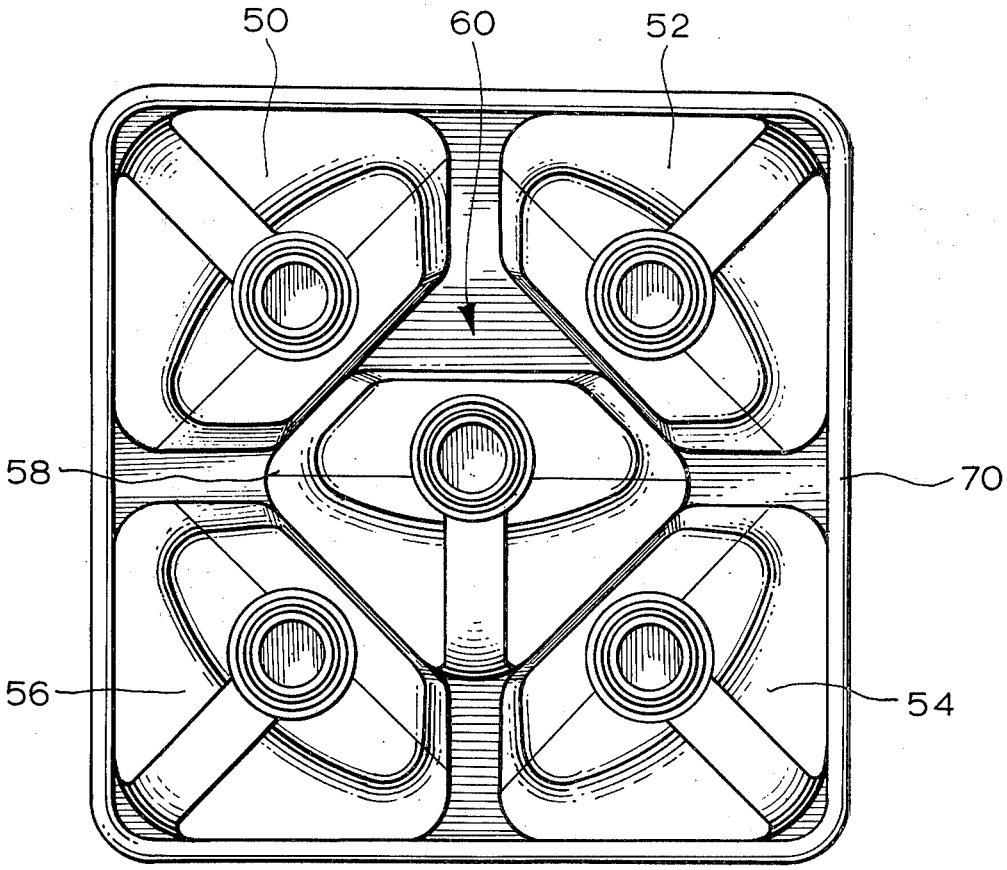

The lateral enclosure which forms the upper portion of the container (essentially the upper half) has only four principal panels (see FIG. 5). These principal panels are rear panel 18, intermediate panels 14, 16 and upper front panel 20. Upper front panel 20 is sloped so that the liquid enclosure is wider near the bottom of the upper portion of the container than at the top. Upper front panel 20 has a slight lateral convex curvature and is connected at its lateral edges to the upper portions of intermediate panels 14, 16. The bottom edges of upper front panel 20 connect and blend in with the upper edges of main front panels 10, 12 at boundary surfaces 30, 32.

The top surface 24 of the container connects together the upper edges of the four principal panels which form the upper portion of the lateral enclosure, rear panel 18, intermediate panels 14, 16 and upper front panel 20. Top surface 24 consists of two principal sloped surfaces 34, 36 from which extends a neck 38 surrounding opening 42 for the passage of the liquid to be enclosed by the container and which is adapted on its upper portion 40 to receive a cap to seal the opening. Neck 38 and opening 42 are located near rear panel 18 to provide for easy pouring.

The preferred embodiment illustrated also includes a flow-thru handle 44 of sufficient size to permit easy hand grasping. The lower end of flow-thru handle 44 is attached at or near the intersection of front panels 10, 12 at rounded corner 11 with boundary surfaces 30, 32 which connect front panels 10, 12 with the upper front panel 20. The upper end of flow-thru handle 44 is attached to upper front panel 20 just below neck 38.

In the particularly preferred three-quart capacity liquid container of this invention, neck 38 and opening 42 are in essentially the same position and at the same height as they would be in a standard one-gallon milk container, which avoids any retooling in the bottling plant. In this particularly preferred container, the intermediate panels 14, 16 are also of sufficient width, approximately 2¼ inches, to promote easy conveying in the bottling plant. The approximate dimensions of this particularly preferred embodiment are: height to base of neck 42, 9 inches; width of rear panel 18, 4 inches; width of front panels 10, 12, 5 inches; height of front panels 10, 12, 4⅝ inches; overall width of container at its widest point, 6½ inches.

While the liquid container of this invention can be made out of a number of materials such as glass and any of a number of plastics, high density polyethylene is preferred.

Another aspect of this invention involves the use of five individual containers falling within the scope of this invention in conjunction with a standard, square packing case or crate. As illustrated in FIG. 6 and as referred to above, the shape of the lower portion of the container of this invention is such that five of them can be arranged to fit within the standard packing case designed for only four square containers. This is made possible by the two opposite sets of parallel panels on each container, one front panel 10 and its parallel intermediate panel 16 and the other front panel 12 and its parallel intermediate panel 14, and the diagonal rear panel 18 which provide room for one fourth of a square opening 60 in the center of crate 70 large enough to receive an additional identically shaped container. In the particularly preferred three-quart capacity embodiment described above, this five in a case arrangement permits 15 quarts of liquid to be carried in a case designed for four gallon size containers instead of the 12 quart maximum which can be carried if scaled down three-quart containers are used.

The embodiments described herein are intended to be exemplary of the types of containers and packing cases arrangements of containers which fall within the scope of this invention. However, one skilled in the art would certainly be expected to be able to make modifications and variations of these preferred embodiments without departing from the spirit and scope of the invention as defined in the following claims.

I claim:

1. A liquid container, comprising:

a series of side panels with at least the lower portion of the container having five principal panels, two wide front panels which intersect and are generally perpendicular to each other, two relatively narrow intermediate panels each of which is connected and generally perpendicular to one of the front panels, and a wide rear panel connected to each of the intermediate panels at an angle of approximately 135°;

a top having a neck extending therefrom, the neck having an opening for the passage of the liquid; and a bottom.

2. The liquid container of claim 1, wherein the upper portion of the container has four principal side panels including the rear panel and the two intermediate panels.

3. The liquid container of claim 1, further comprising a flow-thru handle.

4. The liquid container of claim 1, wherein the lower portion of the container extends at least about half the height of the container.

5. The liquid container of claim 1, wherein the rear wall is slightly convex.

6. The liquid container of claim 1, wherein the liquid capacity of the container is approximately three-quarts.

7. A liquid container, comprising:

a series of side panels with approximately the lower half of the container having five principal panels, two wide front panels which intersect and are essentially perpendicular to each other, two relatively narrow intermediate panels each of which is connected and essentially perpendicular to one of the front panels, and a wide rear panel connected to each of the two intermediate panels at an angle of approximately 135°, and with approximately the upper half of the container having four principal side panels, the rear panel, the two intermediate panels and a sloped upper front panel;

a bottom;

a top having a neck extending therefrom, the neck having an opening for the passage of the liquid; and a flow-thru handle.

8. The liquid container of claim 7, wherein the liquid capacity of the container is approximately three quarts.

9. A container, comprising:

a long, wide rear panel;

two long, relatively narrow side panels adjacent the rear panel;

two relatively short, wide front panels adjacent the lower portion of the side panels, each front panel being generally parallel to the side panel not adjacent to it;

an upper front panel, the lateral edges of which are connected the side panels;

an intermediate surface connecting the upper front panel to the top edges of the front panels;

a bottom connected to the lower edges of the rear panel, side panels, and front panels; and a top connected to the upper edges of the rear panel, side panels, and upper front panel and having an opening.

10. A liquid container, comprising:

a long, wide rear panel;

two long, relatively narrow side panels adjacent the rear panel;

two relatively short, wide front panels adjacent the lower portions of the side panels and which are generally perpendicular to one another, each front panel also being generally parallel to the side panel not adjacent to it;

an upper front panel, the lateral edges of which are connected to the side panels and the bottom edges of which are connected to the upper edges of the front panels;

a bottom connected to the lower edges of the front panels, side panels and rear panel:

a top connected to the upper edges of the rear panel, side panels and upper front panel; and a neck attached to the top having an opening for the passage of the liquid.

11. The liquid container of claim 10, wherein the angle between the rear panel and each of the side panels is approximately 135°.

12. The liquid container of claim 10, wherein the neck is located near the rear panel and further comprising a flowthrough handle.

13. The liquid container of claim 10, wherein the liquid capacity of the container is approximately three quarts.

14. A liquid container, comprising:

a long, wide rear panel;

two long, relatively narrow side panels adjacent the rear panel each being located at an angle of approximately 135° with respect to the rear panel;

two relatively short, wide front panels connected to the lower portions of the side panels and to each other by rounded surfaces and which are generally perpendicular to one another, each front panel also being generally perpendicular to the side panel not adjacent to it;

a sloped, upper front panel, the lateral edges of which are connected to the side panels and the bottom edges of which are connected to the upper edges of the front panels;

a bottom connected to the lower edges of the front panels, side panels, and rear panel;

a top connected to the upper edges of the rear panel, side panels and upper front panel; and a neck extending from the top and located near the rear panel having an opening for the passage of the liquid.

15. The liquid container of claim 14, wherein the front panels each have a single recess.

16. The liquid container of claim 14, further comprising a flow-thru handle.

17. A liquid container having a capacity of approximately three quarts, comprising:

a long, wide rear panel;

two long, relatively narrow side panels connected to the rear panel, each being located at an angle of approximately 135° with respect to the rear panel;

two relatively short, wide front panels connected to the lower portions of the side panels and to each other by rounded surfaces and which are generally both perpendicular to each other and parallel to the opposite side panel;

a sloped, upper front panel, the lateral edges of which are connected to the side panels by rounded surfaces and the bottom edges of which are connected to the upper edges of the front panels;

a bottom connected to the lower edges of the rear panel, side panels and front panels;

a top connected to the upper edges of the rear panel, side panels and upper front panel;

a neck extending from the top and located near the rear panel having an opening for the passage of liquid; and a flow-thru handle, the lower end of which is attached near the intersection of the front panels with the upper front panel and the upper end of which is attached to the upper front panel just below the neck.

18. A carrying case containing five containers, each of which comprises:

a series of side panels with approximately the lower half of the container having five principal panels, two wide front panels which intersect and are generally perpendicular to each other, two relatively narrow intermediate panels each of which is connected and generally perpendicular to one of the front panels, and a wide rear panel connected to each of the two intermediate panels at an angle of approximately 135° and with approximately the upper half of the container having four principal side panels including the rear panel and the two intermediate panels;

a bottom;

a top having a neck extending therefrom, the neck having an opening for the passage of the liquid; and a flow-thru handle.

19. The carrying case of claim 18, wherein each of the containers has a liquid capacity of approximately three quarts.

20. A square sided carrying case containing five containers of the type recited in claim 1.

21. A square sided carrying case containing five three quart capacity containers of the type recited in claim 1.

22. A square sided carrying case containing five containers, each of which comprises:

a long, wide rear panel;

two long, relatively narrow side panels adjacent the rear panel;

two relatively short, wide front panels adjacent the lower portions of the side panels and which are generally perpendicular to one another, each front panel also being generally parallel to the side panel not adjacent to it;

an upper front panel, the lateral edges of which are connected to the side panels and the bottom edges of which are connected to the upper edges of the front panels;

a bottom connected to the lower edges of the front panels, side panels and rear panel;

a top connected to the upper edges of the rear panel, side panels and upper front panel; and a neck attached to the top having an opening for the passage of the liquid.

23. The carrying case of claim 22, wherein each of the containers has a liquid capacity of approximately three quarts.

24. A carrying case containing five containers of the type recited in claim 9.

25. A carrying case containing five containers of the type recited in claim 14.

26. A carrying case containing five three quart capacity containers of the type recited in claim 14.

27. A square sided carrying case containing five containers of the type recited in claim 17.

* * * * *

UNITED STATES PATENT AND TRADEMARK OFFICE

CERTIFICATE OF CORRECTION

PATENT NO. : 4,016,995
DATED : April 12, 1977
INVENTOR(S) : John S. Frazer

It is certified that error appears in the above-identified patent and that said Letters Patent are hereby corrected as shown below:

Column 2, line 7, "on" should be -- to --.

Claim 9, line 38, after "connected" add - - to - -.

Claim 14, line 16, "perpendicular" should be - - parallel - -.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*